US009004891B2

(12) United States Patent
Turner et al.

(10) Patent No.: US 9,004,891 B2
(45) Date of Patent: Apr. 14, 2015

(54) VACUUM PUMP

(75) Inventors: Neil Turner, Godalming (GB); Malcolm William Gray, Crawley (GB); Jack Raymond Tattersall, Lancing (GB)

(73) Assignee: Edwards Limited, Crawley, West Sussex (GB)

( * ) Notice: Subject to any disclaimer, the term of this patent is extended or adjusted under 35 U.S.C. 154(b) by 1087 days.

(21) Appl. No.: 12/532,462

(22) PCT Filed: Apr. 16, 2008

(86) PCT No.: PCT/GB2008/050266
§ 371 (c)(1),
(2), (4) Date: Jan. 18, 2010

(87) PCT Pub. No.: WO2008/129317
PCT Pub. Date: Oct. 30, 2008

(65) Prior Publication Data

US 2010/0172782 A1 Jul. 8, 2010

(30) Foreign Application Priority Data

Apr. 23, 2007 (GB) ..... 0707753.0

(51) Int. Cl.
*F04C 18/12* (2006.01)
*F04C 18/08* (2006.01)
*F04C 25/02* (2006.01)

(52) U.S. Cl.
CPC ..... *F04C 18/123* (2013.01); *F04C 18/126* (2013.01); *Y10S 417/01* (2013.01); *F04C 18/084* (2013.01); *F04C 25/02* (2013.01); *F04C 2220/10* (2013.01); *F04C 2280/02* (2013.01)

(58) Field of Classification Search
CPC .... F04C 18/123; F04C 18/084; F02D 19/082; Y10S 417/01
USPC ..... 418/205, 206.6, 206.5, 196, 117, 141, 418/143, 191, 125, 135, 101
See application file for complete search history.

(56) References Cited

U.S. PATENT DOCUMENTS

| | | | | |
|---|---|---|---|---|
| 2,845,031 | A * | 7/1958 | Guibert | 418/190 |
| 3,071,314 | A * | 1/1963 | Flanagan | 418/113 |
| 3,423,017 | A * | 1/1969 | Schibbye | 418/117 |
| 3,574,491 | A * | 4/1971 | Martin | 418/205 |
| 3,977,817 | A * | 8/1976 | Monteil | 418/196 |

(Continued)

FOREIGN PATENT DOCUMENTS

| | | | |
|---|---|---|---|
| CH | 369540 | A | 5/1963 |
| CN | 1206795 | A | 11/1997 |

(Continued)

OTHER PUBLICATIONS

English Machine Translation of DE2232505A1 to Anton Jung, published on Feb. 22, 1973.*

(Continued)

*Primary Examiner* — Kenneth Bomberg
*Assistant Examiner* — Anthony Ayala Delgado
(74) *Attorney, Agent, or Firm* — Westman, Champlin & Koehler, P.A.

(57) ABSTRACT

A pair of Northey rotors for a vacuum pump, in which each rotor comprises two opposing, substantially parallel faces, and a peripheral surface located between the opposing faces. In order to reduce damage caused by pumping a gas stream containing liquid or solid particulates, a plurality of grooves is located on the peripheral surface for accommodating the particulates.

11 Claims, 4 Drawing Sheets

(56) References Cited

U.S. PATENT DOCUMENTS

| | | | | |
|---|---|---|---|---|
| 4,984,975 | A | 1/1991 | Thompson | |
| 5,335,640 | A | 8/1994 | Feuling | |
| 5,401,151 | A * | 3/1995 | Allen | 418/191 |
| 6,709,250 | B1 * | 3/2004 | Xiong | 418/206.5 |
| 2002/0061256 | A1 * | 5/2002 | Hansen et al. | 418/206.4 |
| 2006/0083651 | A1 | 4/2006 | Lim | |

FOREIGN PATENT DOCUMENTS

| | | | | |
|---|---|---|---|---|
| DE | 2232505 | A1 * | 7/1972 | F04C 18/12 |
| EP | 0365695 | A1 | 5/1990 | |
| EP | 0594461 | A1 | 4/1994 | |
| GB | 15104 | A | 0/1911 | |
| GB | 190425222 | A | 12/1904 | |
| GB | 429171 | A | 5/1935 | |
| JP | S59-054784 | | 4/1984 | |
| JP | 6-200888 | A | 7/1984 | |
| JP | 60237189 | A | 11/1985 | |
| JP | H60-180787 | | 11/1985 | |
| JP | 62111181 | A | 5/1987 | |
| JP | 20000337280 | A | 12/2000 | |
| JP | 2002130167 | A | 5/2002 | |
| JP | 2007154799 | A1 | 6/2007 | |
| WO | 9827341 | A | 6/1998 | |

OTHER PUBLICATIONS

International Search Report dated Aug. 21, 2008 for corresponding International Application No. PCT/GB2008/050266, filed Apr. 16, 2008.

International Written Opinion of the International Searching Authority dated Aug. 21, 2008 for corresponding Application No. PCT/GB2008/050266, filed Apr. 16, 2008.

United Kingdom Search Report dated Aug. 21, 2007 of Application No. GB0707753.0 filed Apr. 23, 2007.

Prosecution history of corresponding Chinese Application No. 200880013523.2 including: Decision on Rejection dated Nov. 29, 2012; First Office Action dated Feb. 11, 2011; Response dated Aug. 17, 2011; Office Action dated Aug. 25, 2011; Second Office Action dated Mar. 5, 2012; Response dated Jul. 4, 2012; Office Action dated Jul. 6, 2012;Third Office Action dated Jun. 4, 2013; Office Action dated Mar. 13, 2013.

Prosecution history of corresponding European Application No. 08737191.0 including: Communication dated May 26, 2010; Response dated Mar. 18, 2011; Communication dated Jun. 17, 2011; Response dated Oct. 27, 2011; Communication dated Dec. 20, 2011.

Prosecution history of corresponding Japanese Application No. 2010504860 including: Notification of Reason for Rejection dated Dec. 25, 2012; Response dated Mar. 20, 2013; Response dated Jun. 6, 2013.

Prosecution history of corresponding Malaysian Application No. PI20094409 including: Substantive Examination dated Jan. 15, 2013; Search Report dated Aug. 7, 2012; Response dated Apr. 2, 2013.

Office Action dated Nov. 7, 2013 and Search Report dated Nov. 5, 2013 for corresponding Taiwanese Application No. 09711470.

* cited by examiner

VACUUM PUMP

FIELD OF THE INVENTION

The present invention relates to a vacuum pump, and to rotor components for a vacuum pump.

BACKGROUND

Vacuum pumps used to draw the gas stream from a process chamber are generally multistage pumps comprising a pair of drive shafts each supporting a plurality of rotors. A housing of the vacuum pump provides a stator within which the drive shafts and rotors rotate during use of the pump. The stator comprises a gas inlet, a gas outlet and a plurality of pumping chambers, with adjacent pumping chambers being separated by a transverse wall. A gas flow duct connects a chamber outlet from one pumping chamber to a chamber inlet of the adjacent, downstream pumping chamber. Each pumping chamber houses a pair of rotors such that there is a small clearance between the rotors, and between each rotor and an inner wall of the pumping chamber. The rotors typically have one of a Roots or Northey ("claw") profile, and the profile of the rotors may change along the drive shafts.

During processes such as chemical vapour deposition, process gases are supplied to a process chamber to form a deposition layer on the surface of a substrate. As the residence time of the process gas in the chamber is relatively short, only a small proportion of the gas supplied to the chamber is consumed during the deposition process. The unconsumed process gas is subsequently pumped from the process chamber with one or more by-products from the process using a vacuum pump.

The gas stream pumped from the process chamber can contain species that may cause damage to the pump. For example, some deposition process generate solid particulates, such as $SiO_2$ particulates, which are exhausted from the process chamber with the unconsumed process gases. In addition some deposition processes use vaporised liquid precursors, such as TEOS, which can condense and/or collect in the pump.

As another example, if the unconsumed process gas or by-product is condensable, condensation on low temperature surfaces within the vacuum line between the process chamber and the vacuum pump, or within the vacuum pump itself, can result in significant amounts of powder or dust passing through the pump.

Any solid or liquid material passing through a twin-shafted vacuum pump is forced between the rotors of the pump, and it has been observed that, over time, this can result in damage to the rotors or, in some cases, cause the rotors to hydraulically lock. For Northey rotors, the damage usually manifests as swelling of the edges of the rotors, which can reduce the size of the clearances between the rotors and between the rotors and the stator. This could compromise the future reliability of the pump, particularly if the pump is operated at higher temperatures as the thermal expansion of the rotors relative to the stator could now lead to contact between the rotors, and/or between a rotor and the stator.

SUMMARY

The present invention provides a Northey rotor for a vacuum pump, comprising two opposing, substantially parallel faces, a peripheral surface located between the opposing faces, and a plurality of grooves located on the peripheral surface.

By providing a plurality of grooves on the peripheral surface of the rotor, solid or liquid material entrained within a gas stream passing through the vacuum pump can be accommodated within the grooves. As a result, the amount of rotor damage caused by the solid or liquid material can be reduced. This can increase the lifetime of the rotors in comparison to rotors that do not have a grooved peripheral surface. In addition, in certain orientations, the grooves can cut through any material already collected in the pump.

The present invention also provides a pair of Northey rotors for a vacuum pump, each rotor comprising two opposing, substantially parallel faces, a peripheral surface located between the opposing faces, and a plurality of grooves located on the peripheral surface for accommodating solid or liquid material entrained within a gas stream pumped by the rotors.

The disposition of the grooves on one of the rotors is preferably different from that on the other rotor. This can reduce the extent of the overlapping of the grooves during rotation of the rotors, and thereby reduce the amount of gas leaking between the overlapping grooves during pumping.

The present invention further provides a pair of Northey rotors for a vacuum pump, each rotor comprising two opposing, substantially parallel faces, a peripheral surface located between the opposing faces, and a pattern of grooves located on the peripheral surface, and wherein the disposition of the pattern on one of the rotors is different from that on the other rotor.

The grooves have a regular or an irregular pattern. Examples of the pattern which the grooves may have include, parallel slots, criss-cross, herringbone, zig-zag, curved and wavy. In one example described below, the grooves have a criss-cross pattern, in which intersecting grooves of the pattern intersect substantially orthogonally. The grooves may have a regular or an irregular pitch.

Some of the grooves may extend between the opposing faces of the rotor. For example, these may extend substantially orthogonally between the opposing faces. As discussed above, the disposition of these grooves on one of the rotors is preferably different from that on the other rotor, and so these orthogonally-extending grooves on one rotor are preferably angularly misaligned relative to the corresponding grooves on the other rotor.

At least one groove may be disposed substantially parallel to and spaced from the opposing faces. Again, the disposition of this groove on one of the rotors is preferably different from that on the other rotor, and so each rotor may have this groove located at a respective different position relative to its faces.

The parallel grooves may be slots located on the peripheral surface of the leading edge of the protruding claw (the beak) of an inlet Northey rotor, as shown in FIGS. 3 and 4. Locating slots on the back of the beak allows the inlet rotor to slice through solid or liquid material collected in the depression (throat) of the exhaust rotor providing a path for a proportion of the material to be expelled out of the gap between the inlet and exhaust rotor at the point they mesh, thus reducing potential damage and/or the hydraulic locking of the rotors.

The parallel grooves may also be slots located on peripheral surface of the lower jaw of the depression (throat) of an inlet Northey rotor, also shown in FIGS. 3 and 4, to provide a path for any material expelled from the rapidly closing rolling clearance between the inlet and exhaust rotors.

The present invention also provides a vacuum pump comprising a chamber housing a pair of rotors, at least one of which is as aforementioned, located on respective shafts and adapted for counter-rotation within the chamber.

The present invention further provides a vacuum pump comprising a chamber housing two Northey rotors located on respective shafts and adapted for counter-rotation within the chamber, each rotor comprising two opposing, substantially parallel faces, a peripheral surface located between the opposing faces, and a plurality of grooves located on the peripheral surface for accommodating solid or liquid material entrained within a gas stream passing through the pump.

The invention further provides a vacuum pump comprising a chamber housing two Northey rotors located on respective shafts and adapted for counter-rotation within the chamber, each rotor comprising two opposing, substantially parallel faces, a peripheral surface located between the opposing faces, and a pattern of grooves located on the peripheral surface, and wherein the disposition of the pattern on one of the rotors is different from that on the other rotor.

BRIEF DESCRIPTION OF THE DRAWINGS

Preferred features of the present invention will now be described with reference to the accompanying drawings, in which.

DETAILED DESCRIPTION

Figure 1:
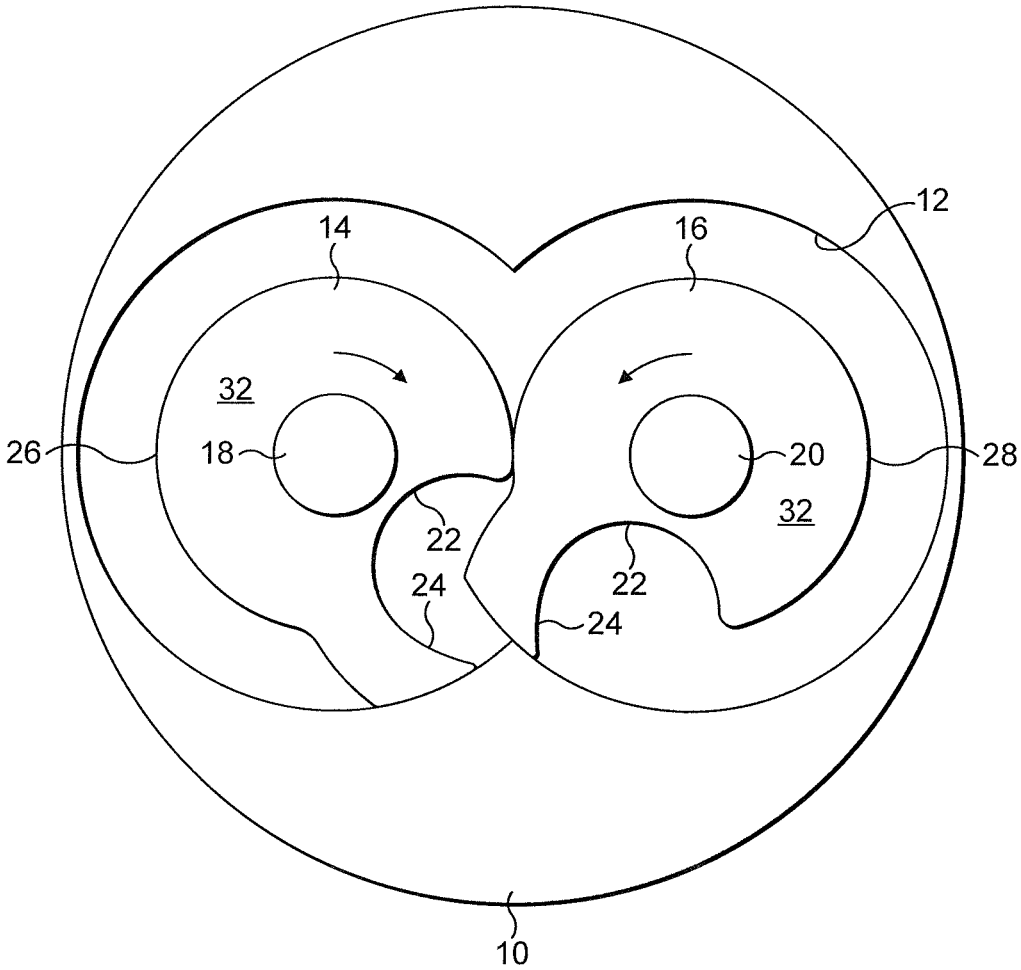
FIG. 1 is a cross-sectional view through a vacuum pump.

With reference first to FIG. 1, a vacuum pump comprises a pump body 10 having a pumping chamber 12 defined therein. A pair of Northey, or "claw", rotors 14, 16 are mounted on respective shafts 18, 20 which are adapted for rotation about their respective axes in opposite directions, as indicated by the arrows in FIG. 1. Over substantially one quadrant, each rotor 14, 16 has a deep depression (or Jaw) 22 followed by a protruding claw (or Beak) 24, with the remaining three quadrants being substantially cylindrical. During rotation the claw 24 of one rotor 14 enters the depression 22 in the other rotor 16, and vice versa, in a meshing, non-contact manner. As indicated in FIG. 1, the rotors 14, 16 are mounted in the chamber 12 with a small radial running clearance between the peripheral surfaces 26, 28 of the rotors 14, 16.

The pumping chamber 12 has an inlet (not shown) and an outlet (not shown), which are disposed axially on opposite sides of the chamber 12. As the rotors 14, 16 rotate, the depression 22 in one of the rotors aligns with the inlet so that gas is drawn into the chamber 12. Further rotation of the rotors 14, 16 closes the inlet to trap a volume of gas within the chamber 12, which becomes compressed between the rotors 14, 16 until the depression 22 in the other rotor becomes aligned with the outlet to enable the compressed volume of gas to be released from the chamber 12.

Any solid or liquid material entrained with the gas entering the chamber 12 can settle or condense on the peripheral surfaces 26, 28 of the rotors. This material can reduce the size of the running clearance between the rotors, and in extreme cases can cause the rotors 14, 16 to touch, resulting in the solid material becoming rolled or spread onto the peripheral surfaces 26, 28. Increased build-up of this material can force the rotors 14, 16 apart, which can result in rotor damage, which usually manifests as swelling of the edges of the rotors.

Figure 2:
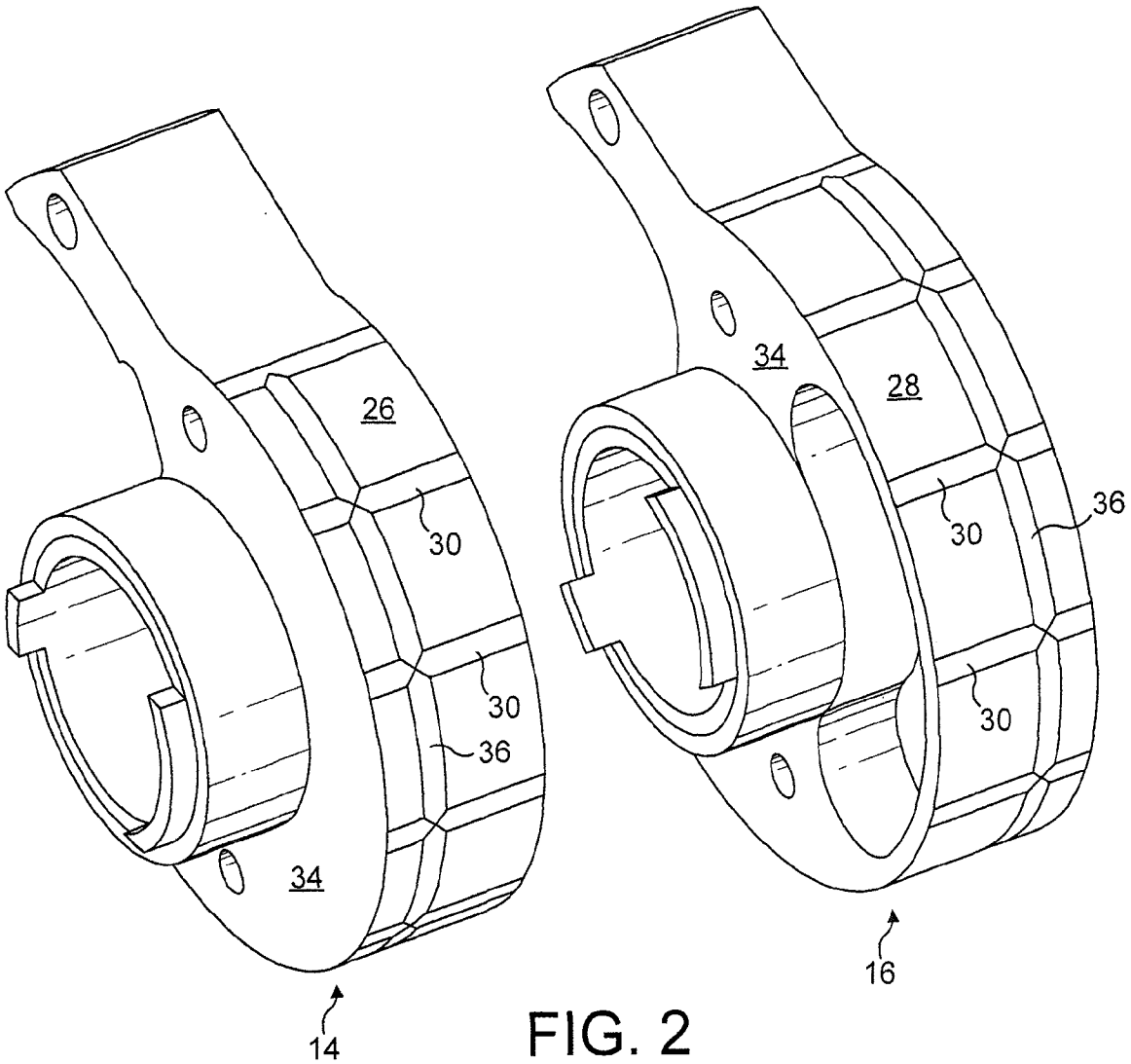
FIG. 2 is a perspective view of the rotors of the pump of FIG. 1.

With reference now to FIG. 2, in order to reduce the amount of rotor damage sustained during the pumping of a gas stream containing solid or liquid material a plurality of grooves are located on the peripheral surface of each rotor 14, 16 for accommodating solid or liquid material entering the chamber 12. In this example the grooves have a regular, criss-cross pattern, comprising a set of grooves 30 which extend substantially orthogonally between the opposing, substantially parallel faces 32, 34 of the rotor, and at least one groove 36 that extends substantially parallel to the opposing faces 32, 34. As indicated in FIG. 2, the disposition of the grooves 30, 36 on rotor 14 is different from that on rotor 16. In this example, the grooves 30 on one rotor 14 are angularly offset relative to the corresponding grooves 30 on the other rotor 16, and the spacing between the groove 36 and face 34 on one rotor 14 is at a different from that on the other rotor 16. This can minimise the extent of the overlapping of the grooves 30, 36 during rotation of the rotors 14, 16 and thereby reduce the amount of gas leaking between the rotors through the overlapping grooves.

Figure 3:
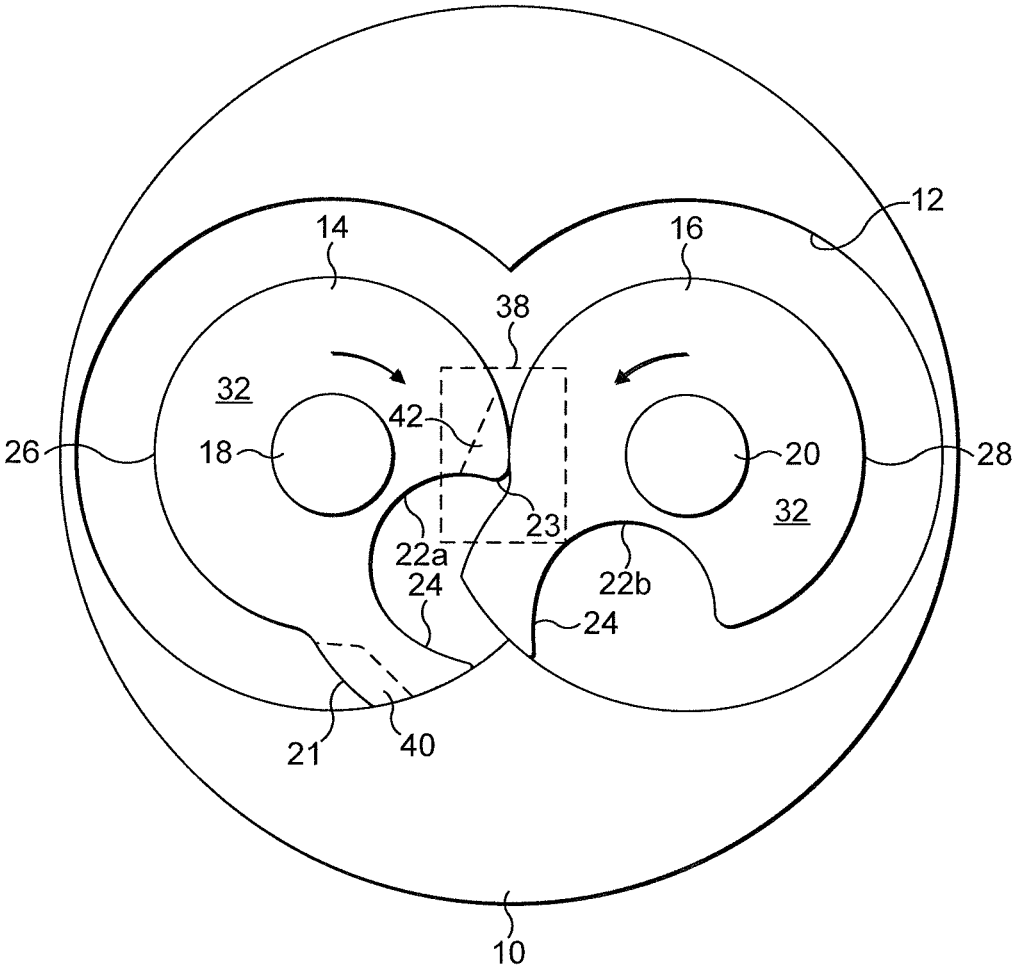
FIG. 3 is also a cross-sectional view through a vacuum pump.
Figure 4:
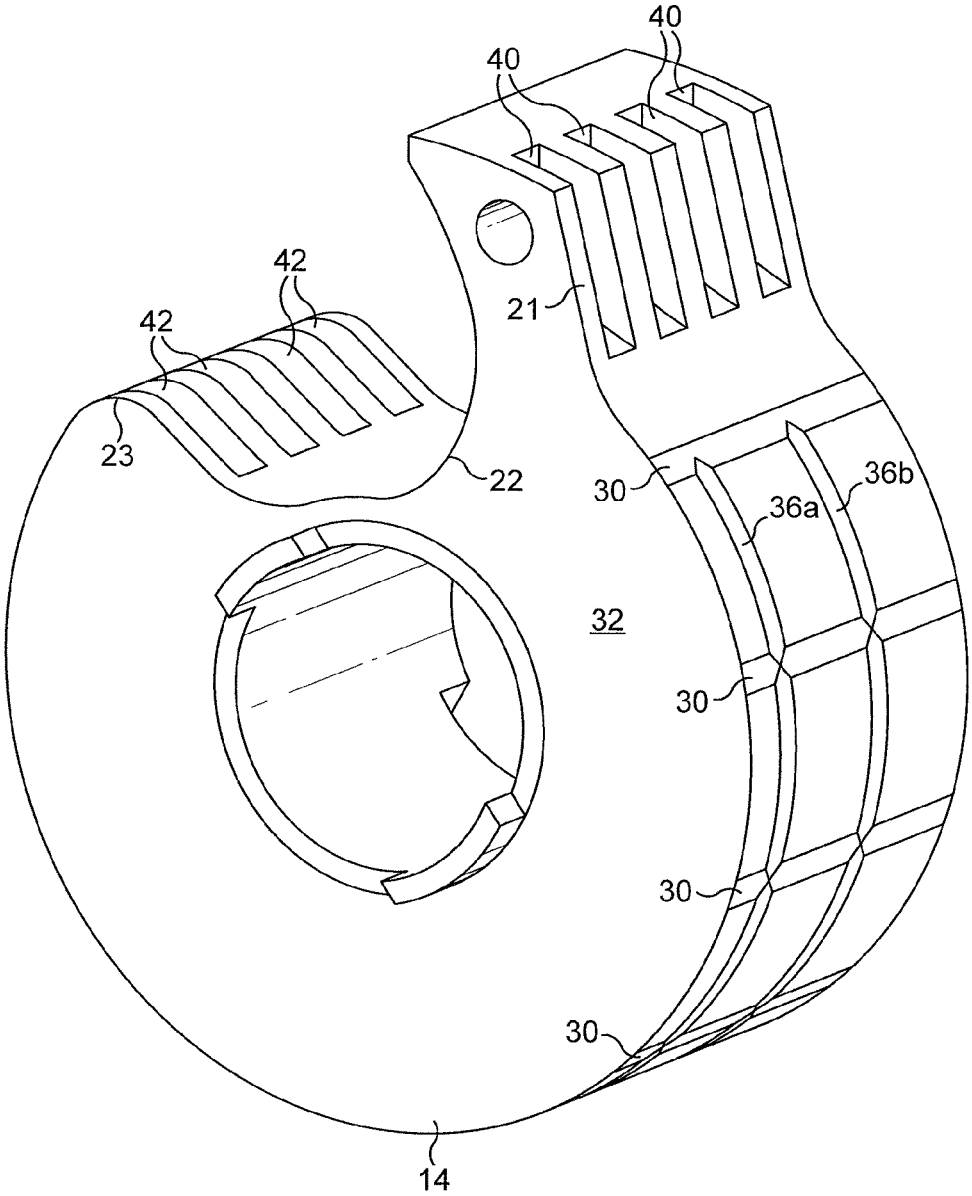
FIG. 4 is a perspective view of a rotor of the pump of FIG. 3.

With reference now to FIG. 3 and FIG. 4, in order to reduce the chance of a hydraulic lock and/or rotor damage sustained during the pumping of a gas stream containing solid or liquid, material grooves in the form of a number of deep parallel slots (40, 42) are located on the peripheral surface (26) of the leading edge (21) of the protruding claw (the beak) and/or on the peripheral surface of the lower jaw (23) of the depression (22*a*) of an inlet Northey rotor (14). The slots (40, 42) provide a route through which solid or liquid material trapped in the depression (22*b*) of the exhaust rotor (16) and/or in the rapidly closing clearance (indicated in the boxed area 38 in FIG. 3) between the two rotors (14, 16) can be expelled, thus protecting the rotors. With both sets of slots (40, 42) on only the inlet rotor (14) the impact on sealing (gas leakage) between the two rotors (14, 16) is minimised and pumping performance affected only minimally for a gain in solid or liquid material handling performance. Also show in FIG. 4 is a plurality of grooves 30 which extend substantially orthogonally between the opposing, substantially parallel faces 32, 34 of the rotor, and two grooves 36*a* and 36*b* that extends substantially parallel to the opposing faces 32, 34.

We claim:

1. An apparatus comprising:

a Northey rotor for a vacuum pump, the Northey rotor comprising two opposing, substantially parallel faces, a peripheral surface located between the opposing faces and comprising a substantially cylindrical portion extending from a claw portion to a depression portion, the claw portion protruding from the substantially cylindrical portion and extending from the depression portion to the substantially cylindrical portion, and a plurality of grooves located on the peripheral surface, wherein at least one of the grooves is substantially parallel to the substantially parallel faces and is spaced from at least one of the substantially parallel faces.

2. A pair of Northey rotors for a vacuum pump, each rotor comprising:

two opposing, substantially parallel faces;

a peripheral substantially cylindrical surface located between the opposing faces and extending from a claw on the rotor to a depression on the rotor, the claw protruding from the substantially cylindrical surface and extending from the depression to the substantially cylindrical surface; and a plurality of grooves located on the peripheral substantially cylindrical surface and extending substantially orthogonally to the substantially parallel faces for accommodating solid or liquid material entrained within a gas stream pumped by the rotors wherein the grooves that extend substantially orthogonally on a first of the pair of rotors are angularly offset from each of the grooves that extend substantially orthogonally on a second of the pair of rotors.

3. A pair of Northey rotors for a vacuum pump, each rotor comprising:

substantially one quadrant comprising a claw and a depression; and two opposing, substantially parallel faces, a peripheral substantially cylindrical surface located between the opposing faces and extending from the claw to the depression, and at least two grooves on the substantially cylindrical surface that intersect each other on the substantially cylindrical surface, and wherein the disposition of intersecting grooves on one of the rotors is different from that on the other rotor.

4. The rotors according to claim 2, wherein the grooves have a regular pattern.

5. A vacuum pump comprising a chamber housing a pair of rotors according to claim 2 located on respective shafts and adapted for counter-rotation within the chamber.

6. A vacuum pump comprising:

a chamber housing two Northey rotors located on respective shafts and adapted for counter-rotation within the chamber; and each Northey rotor comprising two opposing, substantially parallel faces, a peripheral surface located between the opposing faces, the peripheral surface comprising a substantially cylindrical portion, a claw portion protruding from the substantially cylindrical portion and a depression extending from the claw portion to the substantially cylindrical portion, and a plurality of grooves located on the peripheral surface for accommodating solid or liquid material entrained within a gas stream passing through the pump wherein linear grooves that extend substantially orthogonally between the substantially parallel faces on the substantially cylindrical portion of a first rotor are positioned to minimize overlap with linear grooves that extend substantially orthogonally between the substantially parallel faces on the substantially cylindrical portion of a second rotor.

7. A vacuum pump comprising:

a chamber housing two Northey rotors located on respective shafts and adapted for counter-rotation within the chamber;

each Northey rotor comprising two opposing, substantially parallel faces, a peripheral surface located between the opposing faces comprising a substantially cylindrical portion, a protruding claw portion and a depression wherein the substantially cylindrical portion extends from the protruding claw portion to the depression, and a pattern of grooves located on the substantially cylindrical portion of the peripheral surface, and wherein the disposition of the pattern on one of the rotors is different from that on the other rotor and wherein at least one of the grooves in the pattern of grooves is spaced from the opposing faces.

8. The vacuum pump of claim 7 wherein the grooves spaced from opposing faces on a first of the two Northey rotors are disposed differently than the grooves spaced from opposing faces on a second of the two Northey rotors.

9. The vacuum pump of claim 8 further comprising slots located on the peripheral surface of a leading edge of the protruding claw of only the first of the two Northey rotors.

10. The vacuum pump of claim 8 further comprising slots located on the peripheral surface of a lower jaw of the depression of only the first of the two Northey rotors.

11. The pair of Northey rotors of claim 2 wherein the grooves have an irregular pitch.

* * * * *